US005333204A

United States Patent [19]

Hamada et al.

[11] Patent Number: 5,333,204

[45] Date of Patent: Jul. 26, 1994

[54] SPEAKER SYSTEM

[75] Inventors: Hiroyuki Hamada; Takahiro Naka, both of Saitama, Japan

[73] Assignee: Pioneer Electronic Corporation, Tokyo, Japan

[21] Appl. No.: 861,742

[22] Filed: Apr. 1, 1992

[30] Foreign Application Priority Data

Aug. 9, 1991 [JP] Japan ..... 3-224597

[51] Int. Cl.[5] ..... H04R 25/00

[52] U.S. Cl. ..... 381/158; 381/154; 181/151

[58] Field of Search ..... 381/154, 159, 158, 156, 381/188, 205; 181/156, 146, 151, 182, 196, 198, 199

[56] References Cited

U.S. PATENT DOCUMENTS 4,837,837 6/1989 Taddeo ..... 381/159
5,012,890 5/1991 Nagi et al. ..... 381/159

FOREIGN PATENT DOCUMENTS 0336303 10/1989 European Pat. Off. ..... 381/159
0429129 5/1991 European Pat. Off. ..... 381/159
0096782 12/1979 Japan ..... 381/159

*Primary Examiner*—Curtis Kuntz
*Assistant Examiner*—Huyen D. Le
*Attorney, Agent, or Firm*—Nikaido, Marmelstin, Murray & Oram

[57] ABSTRACT

A speaker system has a bass-reflex duct provided in a cabinet. A sub-duct is provided on a central portion of the bass-reflex duct. The sub-duct is communicated with the bass-reflex duct, and filled with sound absorbing material for absorbing unnecessary resonance generated in the bass-reflex duct.

1 Claim, 5 Drawing Sheets

SPEAKER SYSTEM

BACKGROUND OF THE INVENTION

The present invention relates to a speaker system having a bass-reflex cabinet.

In the speaker system, the formation of the cabinet affects the reproduction of low frequency sound. There are various types of the cabinets, such as an air-tight cabinet and a bass-reflex cabinet. The air-tight cabinet comprises a closed box for absorbing the sound wave radiated from a speaker unit to at the rear portion of the cabinet. The bass-reflex cabinet is provided with a port formed in the front panel of the closed box. The sound rearwardly radiated in the cabinet is discharged from the port for increasing the low frequency characteristic.

FIG. 10 shows a conventional bass-reflex cabinet. A cabinet 1 comprises a speaker unit 2 secured to the front panel of the cabinet 1 in a central portion thereof. A bass-reflex duct 3 having a predetermined length is secured to the front panel of the cabinet 1 at a lower portion of the cabinet 1. A sound absorbing material 4 is laid on the inside walls of the cabinet 1.

When the speaker unit 2 emits sound, a part of the sound is radiated in the rearward direction in the cabinet 1 and enters the duct 3 from an opening 3*b*. The sound is corrected into the same phase as the sound forwardly radiated from the speaker unit 2 and emitted from a port 3*a*. Thus, the low sound characteristic is increased.

Since the duct 3 is opened at both ends, impedance as view from one end is extremely reduced when $$fn=n(c/2L'),$$

because of resonance, where fn is the frequency, c is the sound velocity, L′ is an equivalent length of the duct, and n is an integer. The equivalent length L′ is determined by the length L of the duct and a correcting value ΔD of the diameter D of the port of the duct.

The frequency fn is generally in a range of 300 Hz or more which is a middle sound range. Namely, the middle sound range is enhance, so that the low sound is not increased. In addition, the sound pressure in the cabinet is reduced due to the resonance. Consequently, the sound pressure of the sound forwardly emitted from the speaker reduces, so that the frequency characteristic is uneven and the transient characteristic is also deteriorated.

In the bass-reflex cabinet, the low frequency characteristic is adjusted by determining the opening area and the length of the duct. In order to obtain a desired low frequency characteristic, in the case that it is necessary to use the duct having a long length, a long duct must be bent in the cabinet. However, velocity of the sound wave in the bent duct is not constant at a bent portion thereof. Since the velocity becomes faster at an inner corner of the bent portion to increase the resistance, so that the resonance Q is reduced. Accordingly, the low frequency characteristic reduces.

Furthermore, the duct 3 is cantilevered on a front panel of the cabinet 1. Consequently, the duct 3 may be vibrated by the sound pressure during the reproduction. The vibration generates a sound pressure which cause the quality of the reproduced sound to be deteriorated.

SUMMARY OF THE INVENTION

An object of the present invention is to provide a speaker system having a flat frequency characteristic, thereby increasing the reproduction efficiency and the quality of the reproduced sound.

According to the present invention, there is provided a speaker system having a bass-reflex duct provided in a cabinet, comprising a sub-duct provided on a central portion of the bass-reflex duct, and communicated with the bass-reflex duct, sound absorbing material provided in the sub-duct for absorbing unnecessary resonance generated in the bass-reflex duct.

In an aspect of the present invention, a bent bass-reflex duct is provided in the cabinet in which a sub-duct having sound absorbing material is provided adjacent a bent portion of the bent duct for correcting speed of the wave front of the sound.

The other objects and features of this invention will become understood from the following description with reference to the accompanying drawings.

DETAILED DESCRIPTION OF THE PREFERRED EMBODIMENTS

Figure 1:
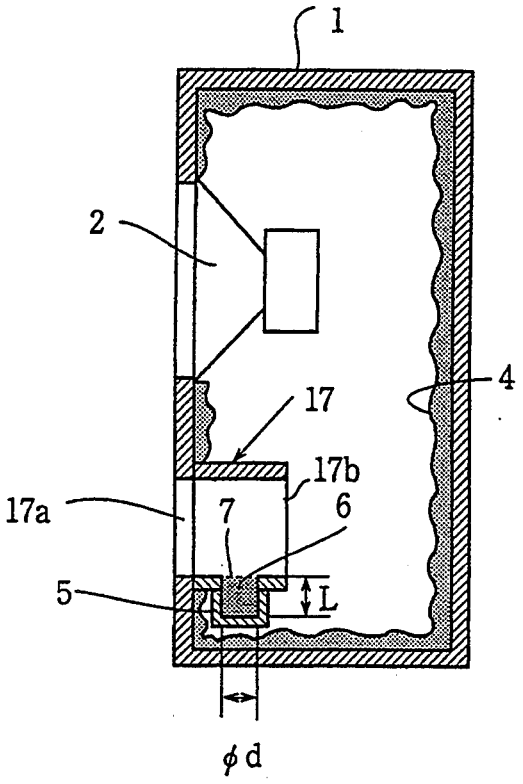
FIG. 1 is a sectional side view showing a cabinet of a speaker system according to the present invention.
Figure 10:
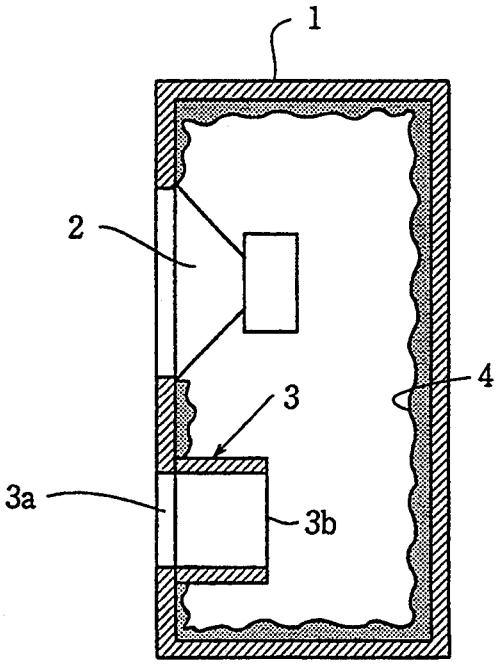
FIG.10 PRIOR ART
FIG. 10 is a sectional side view showing a conventional speaker system.

Referring to FIG. 1 showing a bass-reflex cabinet of a speaker system according to the present invention, the same component parts as the conventional system of FIG. 10 are identified with the same reference numerals as FIG. 10.

The bass-reflex cabinet 1 has a cylindrical bass-reflex duct 17 mounted on the front panel of the cabinet at a lower portion of the speaker unit 2. A cylindrical sub-duct 5 is provided at a central lower portion of the duct 17 and outwardly projected there-from. The sub-duct 5 has a closed end and a length of L and an inner diameter of ϕd. A sound absorbing material 6 is provided in the sub-duct 5. The sound absorbing material 6 is made of fine fiber and preferably has the density of 0.05 g/cm$^3$ or less. A jersey net 7 is provided on an opening of the sub-duct 5 to cover the opening.

Describing the operation of the sub-duct 5, the length L of the sub-duct is determined based on a following equation.

$$L=(c/4fr)-0.4d$$

where c is sound velocity, fr is an unnecessary resonance frequency of the duct 17, and d is the inner diameter of the sub-duct 5.

During the reproduction of the sound by the speaker unit 2, when there occurs resonance in the duct 17 by the sound radiated from the back of the speaker unit 2 into the cabinet 1, the resonating frequency is canceled by the resonance effect of the sub-duct 5 dependent on the length L. Thus, the low frequency characteristic of the sound radiated from the speaker increases.

Figure 2:
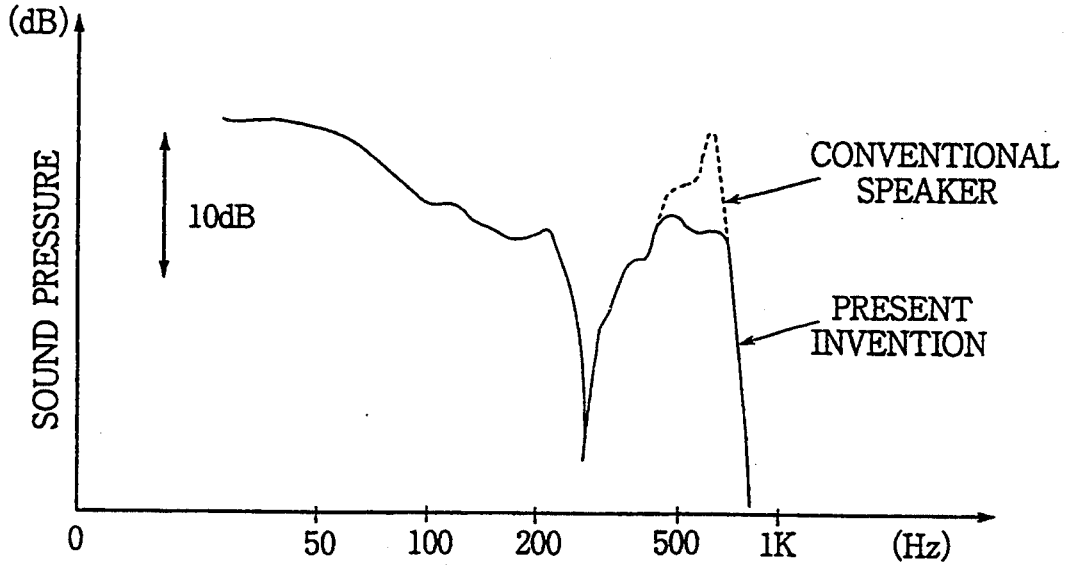
FIG. 2 is a graph showing a sound pressure characteristic in a duct of the speaker system.

FIG. 2 shows the graph of the sound pressure characteristic in the duct 17 compared with that of the conventional duct. It will be seen that the sound pressure of the present invention is reduced at about 500 Hz.

Figure 3:
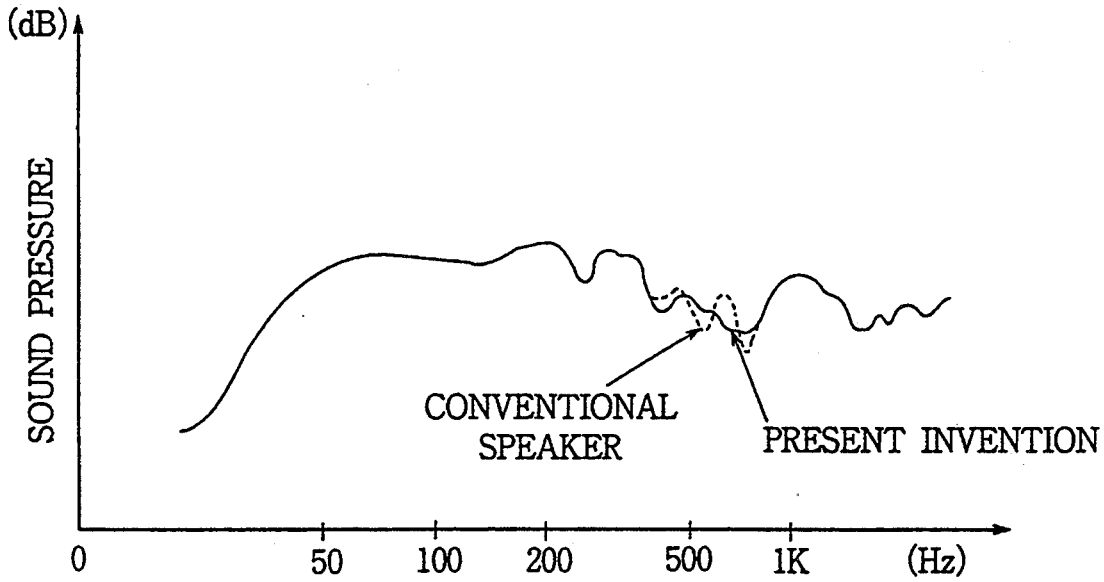
FIG. 3 is a graph showing a sound pressure characteristic of the system.

FIG. 3 shows the graph of speaker characteristics. The speaker characteristic of the present invention becomes flat at around 500 Hz compared with the conventional speaker. In other words, the frequency characteristic of the sound radiated from a port 17*a* of the sub-duct 17 is not disturbed.

Figure 4:
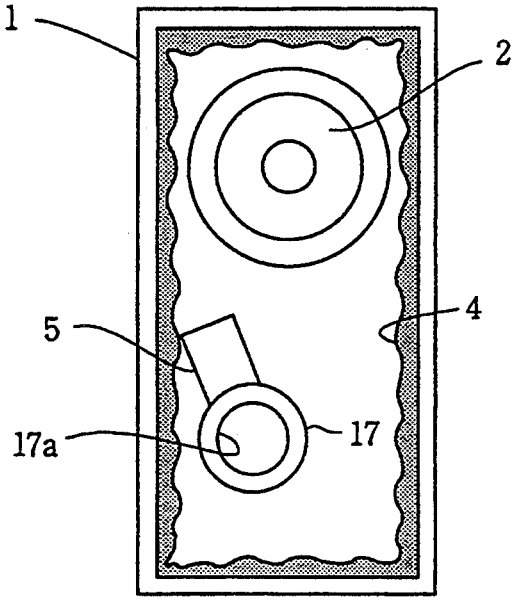
FIG. 4 is a front view showing a modification of the system of FIG. 1, in which a front panel of the speaker is removed for the convenience of illustration.

FIG. 4 shows a different arrangement of the duct 17 in which a front panel of the speaker is removed. When the duct 17 is mounted on the front board of the cabinet 1, the sub-duct 5 is inclined toward the inner wall of the side board of the cabinet such that a part of the outer periphery of the sub-duct 5 is abutted on the sound absorbing material 4 provided thereon.

If the duct 17 is vibrated, the material 4 absorbs the vibration of the duct 17, thereby remarkably suppressing the vibration. Since the frequency characteristic of the sound from the port 17*a* is also improved by the sub-duct, the sound quality is further increased.

Figure 5:
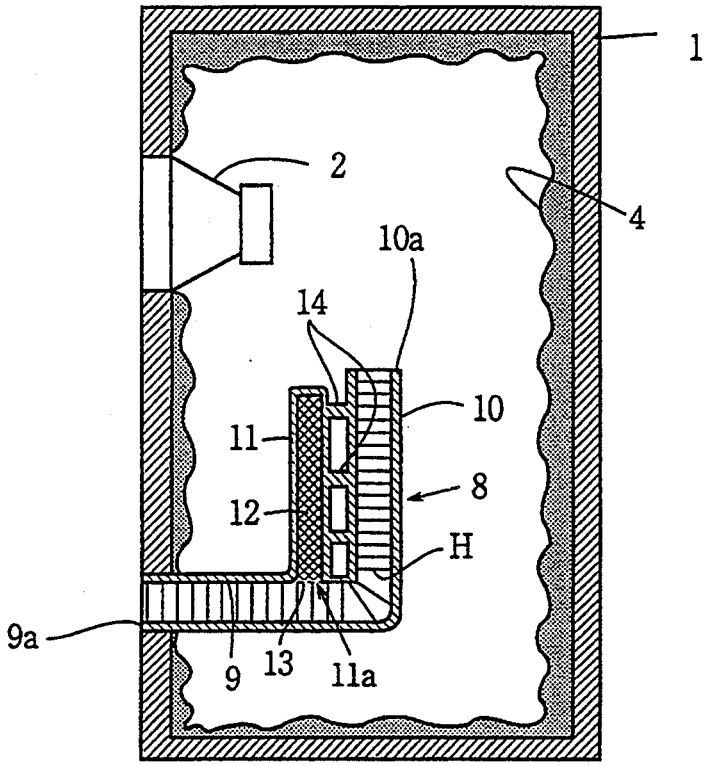
FIG. 5 is a sectional side view showing another embodiment of the system of the present invention.
Figure 6:
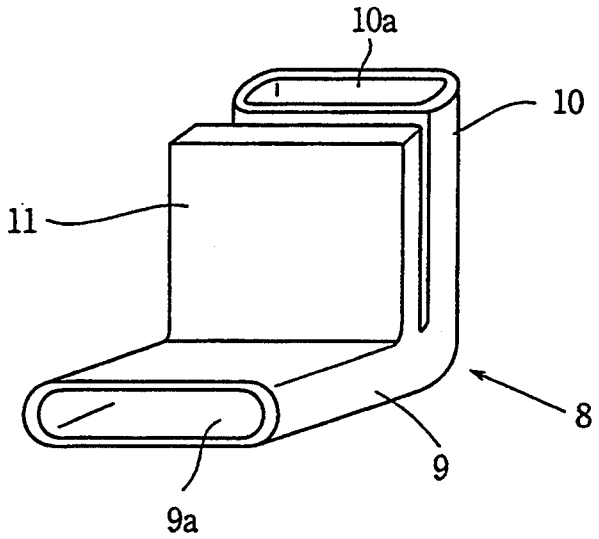
FIG. 6 is a perspective view showing a duct of the system of FIG. 5.

FIGS. 5 and 6 show another embodiment of the system in which a bent duct 8 having an L-shaped section is provided in the bass-reflex cabinet 1.

The bent duct 8 comprises a base duct portion 9, a vertical duct portion 10 formed upwardly bent from the base portion 9. A sub-duct 11 having a closed end is vertically mounted on the base duct portion 9 parallel with the vertical duct portion 10, and supported by ribs 14 from the vertical duct portion 10. An opening 11*a* is provided adjacent to a bent portion of the duct 8. A sound absorbing material 12 having the density of less than 0.05 g/cm$^3$ is inserted in the sub-duct 11. A jersey net 13 is attached to the periphery of the opening 11*a* for preventing the material 12 from falling in the base portion 9.

A port 9*a* of the base portion 9 is opened at a lower portion of the front board of the cabinet 1. An opening 10*a* of the vertical duct portion 10 is disposed in the cabinet adjacent to the speaker unit 2.

In operation, the sound wave radiated from the speaker unit 2 enters the vertical duct portion 10 from the opening 10*a* and is transmitted to the base portion 9 through the vertical portion 10. The wave front H of the sound wave horizontally passes down the vertical duct portion 10. At an intersection between the duct portions 10 and 9, the wave front H passes faster at the inside corner than the outside corner.

However, when the wave front H passes the base portion 9 and reaches the opening 11*a* of the sub-duct 11, the sound absorbing material 12 in the sub-duct 11 absorbs the excessive speed, thereby uniforming the sound velocity. Thus, sound wave having the uniform wave front is radiated from the port 9*a*.

In the embodiment, the reproduction loss is reduced, thereby increasing the reproduction efficiency.

Figure 7:
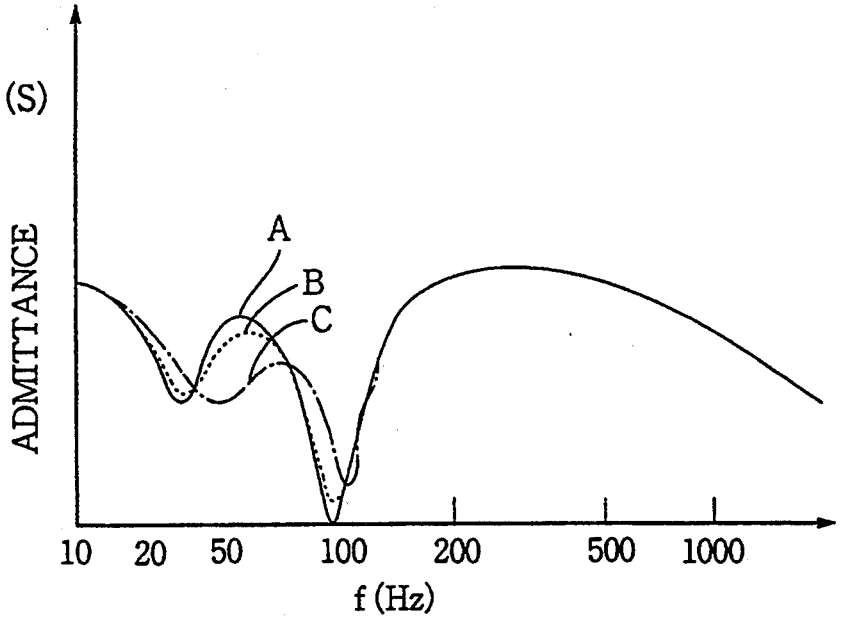
FIG. 7 is a graph showing admittance characteristic of the system of FIG. 5.

FIG. 7 shows the graph of admittance characteristics. A line A represents an admittance characteristic of the system of the present invention. A line B represents a characteristic of a conventional system having a bent duct without a sub-duct such as the sub-duct 11. A line C represents a characteristic of a conventional system having a bent duct with holes.

At low frequency bands between 50 Hz and 60 Hz, the present invention A has higher admittance compared with the conventional system B. The embodiment of the present invention has a flat characteristic compared with the system B and C.

Figure 8:
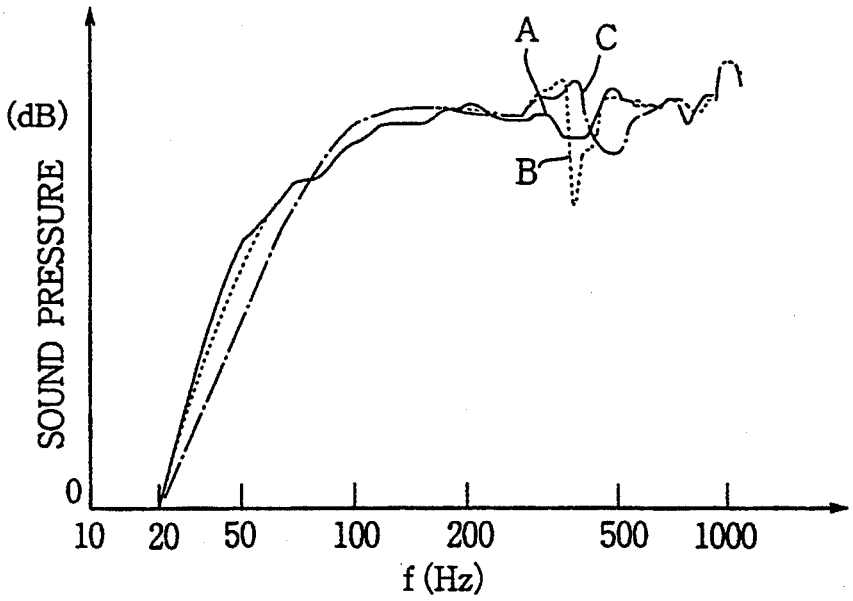
FIG. 8 is a graph showing a sound pressure characteristic thereof.

FIG. 8 shows the graph of the sound pressure characteristics. The sound pressure of the present invention A becomes flat at the frequencies between 200 Hz and 1,000 Hz compared with the conventional systems B and C.

Figure 9:
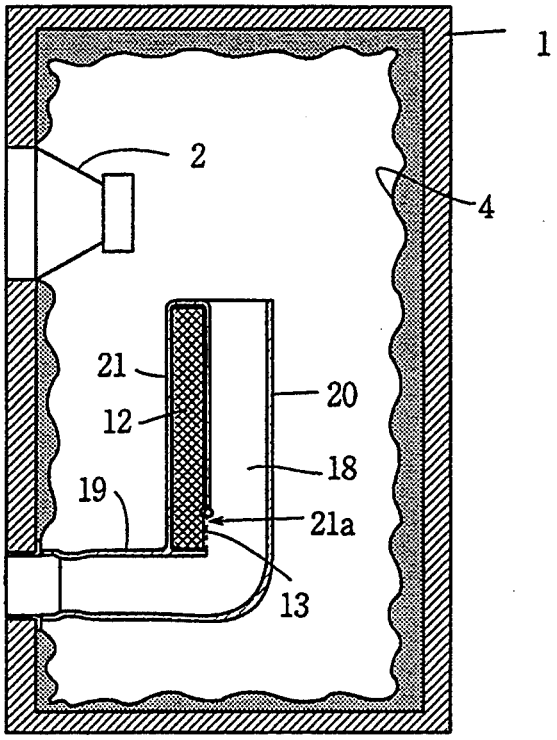
FIG. 9 is a sectional side view showing a further embodiment of the present invention.

FIG. 9 shows a further embodiment using a bent duct.

A bent duct 18 comprises a base duct portion 19 and a vertical duct portion 20. A sub-duct 21 is formed integral with the vertical duct portion 20 and has the sound absorbing material 12 therein. An opening 21*a* of the sub-duct 21 is exposed to the inside of the vertical portion 20 adjacent to the intersection between the duct portions 18 and 19.

In operation, the wave front of the sound wave is previously corrected to be rough in concentration by the sub-duct 21 when passing the vertical duct portion 20. At the intersection, the inner portion of the wave front flows faster, so that the speed of the wave front becomes uniform in the base duct portion 19. Thus, the reproduction efficiency at the low frequency is improved.

The sub-duct is integrated with the vertical duct portion 20 so that the bent duct 18 is reinforced.

In accordance with the present invention, the sub-duct is provided on the bass-reflex duct to absorb the unnecessary resonance, thereby improving the frequency characteristic of the speaker. The sub-duct is provided near the bent portion of the bend duct for correcting the speed of the front wave of the sound.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A speaker system having a bass-reflex duct provided in a cabinet, comprising:

a sub-duct provided on a central portion of the bass-reflex duct, and communicated with the bass-reflex duct;

sound absorbing material provided in said sub-duct for absorbing unnecessary resonance generated in the bass-reflex duct;

wherein a length of said sub-duct is determined by $$L=(c/4fr)-0.4d$$

wherein L is the length of the sub-duct, c is sound velocity, fr is an unnecessary resonance frequency of the bass-reflex duct, and d is an inner diameter of said sub-duct.

* * * * *